US005103848A

United States Patent [19]

Parsons

[11] Patent Number: 5,103,848

[45] Date of Patent: Apr. 14, 1992

[54] SUNSHADE UMBRELLA

[76] Inventor: Gerald W. Parsons, 6900 N. Van Diver #G104, San Antonio, Tex. 78209

[21] Appl. No.: 512,929

[22] Filed: Apr. 23, 1990

[51] Int. Cl.[5] ..... A45B 11/00

[52] U.S. Cl. ..... 135/20.2; 52/2.21

[58] Field of Search ..... 135/20.2, 33.2, 33.7; 52/2.21

[56] References Cited

U.S. PATENT DOCUMENTS

| | | | |
|---|---|---|---|
| 144,792 | 11/1973 | Prentiss | 135/33.2 |
| 2,039,987 | 5/1936 | Goldman | 135/33.2 |
| 2,049,380 | 7/1936 | Huber | 135/20.2 |
| 2,546,099 | 3/1951 | Jamison | 135/33.7 |
| 2,985,179 | 5/1961 | Givens | 135/33.2 |
| 3,226,285 | 12/1965 | Iovenko | 52/2 |
| 3,456,661 | 7/1969 | Farley | 135/33.7 |
| 3,498,306 | 3/1970 | Edelking | 135/33.2 |
| 3,683,947 | 8/1972 | Muller | 135/20.2 |
| 3,863,660 | 2/1975 | Glaeser | 135/33.2 |
| 3,994,102 | 11/1976 | Johnson | 52/2.21 |
| 4,643,210 | 2/1987 | Feld | 135/20.2 |

FOREIGN PATENT DOCUMENTS

| | | | |
|---|---|---|---|
| 62146 | 4/1968 | Fed. Rep. of Germany | 135/20.2 |
| 633713 | 2/1928 | France | 135/33.2 |

*Primary Examiner*—Henry E. Raduazo
*Attorney, Agent, or Firm*—Leon Gilden

[57] ABSTRACT

An apparatus including a central post mounting an umbrella to minimize heat and light directed to an individual while permitting flow of air therethrough. The apparatus includes a central support column with a downwardly directed concave canopy. The canopy is formed of a heat reflective mesh lattice work of orthogonally arranged matrices of fibers. The fibers are of a polymeric or vinyl coating defining a 20×30 mesh. Modifications of the instant invention include each of the fibers further including a reflective layer surmounted upon each fiber and including a transparent layer overlying each reflective layer. The transparent layers are optionally formed of pneumatic chambers.

1 Claim, 4 Drawing Sheets

PRIOR ART

SUNSHADE UMBRELLA

BACKGROUND OF THE INVENTION

1. Field of the Invention

The field of invention relates to umbrellas, and more particularly pertains to a new and improved sunshade umbrella wherein the same provides a heat reflective mesh lattice work canopy formed of polymeric fibers.

2. Description of the Prior Art

Umbrellas and sunshades of various types have been set forth in the prior art. It is desirable for various individuals, due to allergy problems associated with excessive sunlight or physical impairment, to limit exposure to sun and its heat and light. The instant invention attempts to overcome deficiencies of the prior art by utilizing a portably supported and manipulatable structure, wherein an individual may transport a convenient and lightweight organization defined by an opened mesh network that simultaneously redirects heat and sunlight away from an individual transporting the structure, while simultaneously permitting air currents to be received through the canopy of the organization. Examples of the prior are include U.S. Pat. No. 3,850,187 to Hisler provides a structural fixedly mounted shade which includes various parallel layers of material mounted to a framework to define a louvered appearance.

U.S. Pat. No. 4,643,210 to Feld sets forth an inflatable umbrella wherein a pressurized container is mounted within the handle of the container to direct air through circular and radially interconnected passages of the canopy.

U.S. Pat. No. 3,863,660 to Glaeser sets forth a beach umbrella including a multiplicity of openings to permit passage of air therethrough, while minimizing sunlight directed through the shading canopy.

U.S. Pat. No. 4,836,231 to Peterson sets forth a shade structure for use in a beach environment, wherein a plurality of ribs pivoted about a common point at one end define a fan-like pattern of shading elements.

U.S. Pat. No. 4,794,939 to Okuda sets forth an umbrella wherein at least a portion of peripheral edge is shirred. The shirred edge portion is stretched to a greater length when the umbrella is in an opened position.

As such, it may be appreciated that there continues to be a need for a new and improved sunshade umbrella wherein the same addresses both the problems of ease of use, as well as effectiveness in construction in permitting passage of air through the shade structure of the umbrella while simultaneously reflecting heat and sunlight from the canopy shade of the organization and in this respect, the present invention substantially fulfills this need.

SUMMARY OF THE INVENTION

In view of the foregoing disadvantages inherent in the known types of umbrella constructions now present in the prior art, the present invention provides a sunshade umbrella wherein the same provides a mesh fabric network defining a sunshade to minimize passage of heat and light throughout the shade while simultaneously permitting passage of air flow therethrough. As such, the general purpose of the present invention, which will be described subsequently in greater detail, is to provide a new and improved sunshade umbrella which has all the advantages of the prior art umbrella constructions and none of the disadvantages.

To attain this, the present invention comprises an apparatus including a central post mounting an umbrella to minimize heat and light directed to an individual while permitting flow of air therethrough. The apparatus includes a central support column with a downwardly directed concave canopy. The canopy is formed of a heat reflective mesh lattice work of orthogonally arranged matrices of fibers. The fibers are of a polymeric or vinyl coating defining a $20 \times 30$ mesh. Modifications of the instant invention include each of the fibers further including a reflective layer surmounted upon each fiber and including a transparent layer overlying each reflective layer. The transparent layers are optionally formed of a pneumatic chambers.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved sunshade umbrella which has all the advantages of the prior art umbrella constructions and none of the disadvantages.

It is another object of the present invention to provide a new and improved sunshade umbrella which may be easily and efficiently manufactured and marketed.

It is a further object of the present invention to provide a new and improved sunshade umbrella which is of a durable and reliable construction.

An even further object of the present invention is to provide a new and improved sunshade umbrella which is susceptible of a low cost of manufacture with regard to both materials and labor, and which accordingly is then susceptible of low prices of sale to the consuming public, thereby making such sunshade umbrellas economically available to the buying public.

Still yet another object of the present invention is to provide a new and improved sunshade umbrella which provides in the apparatuses and methods of the prior art some of the advantages thereof, while simultaneously overcoming some of the disadvantages normally associated therewith.

Still another object of the present invention is to provide a new and improved sunshade umbrella wherein the same permits passage of air flow through the sunshade portion of the umbrella while simultaneously reflecting heat and sunlight from the sunshade of the umbrella construction.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
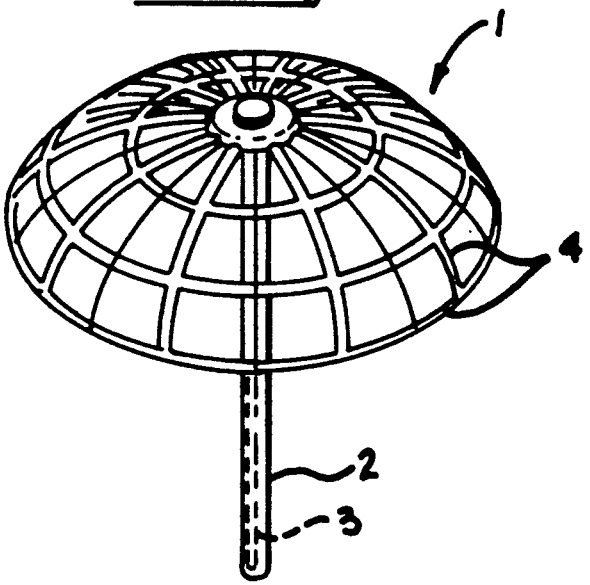
FIG. 1 is an isometric illustration of a prior art umbrella construction.

With reference now to the drawings, and in particular to FIGS. 1 to 8 thereof, a new and improved sunshade umbrella embodying the principles and concepts of the present invention and generally designated by the reference numeral 10 will be described.

Figure 2:
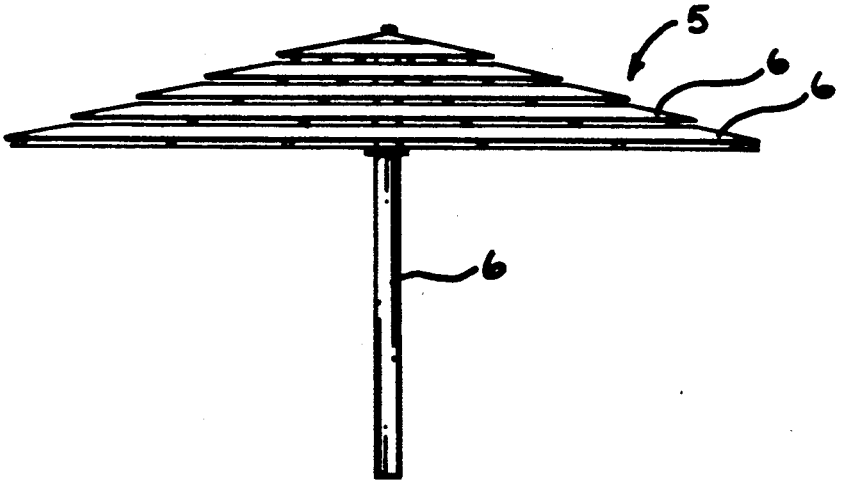
PRIOR ART FIG 2
FIG. 2 is an orthographic view, taken in elevation, of a prior art sunshade umbrella.
Figure 3:
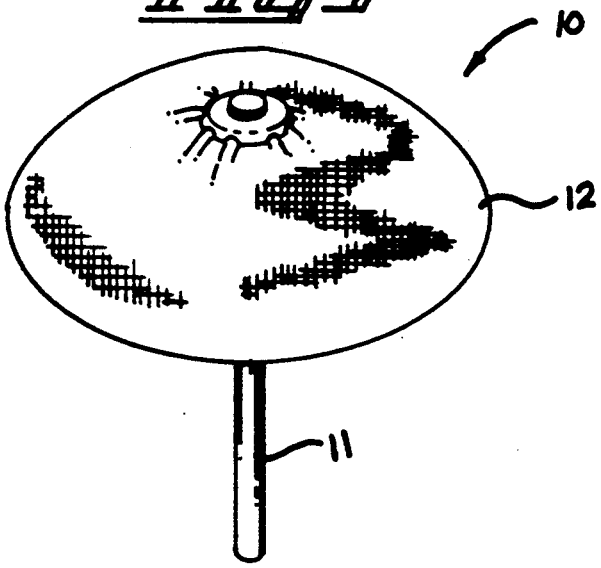
FIG. 3 is an isometric illustration of the instant invention.

FIG. 1 illustrates a prior art umbrella construction 1, wherein radial and circular ribs 4 are in communication with a canister 3 to permit pressurized air to be directed through the support 2 of the umbrella to inflate the canopy construction. FIG. 2 illustrates a further prior art sunshade structure 5 wherein the support 6 includes a plurality of layers of stepped louvers to effect shade underlying an individual while permittng air flow therethrough.

Figure 4:
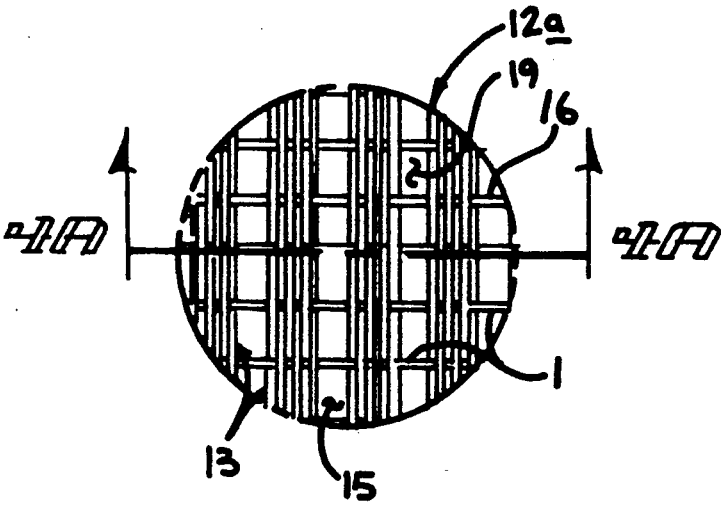
FIG. 4 is an orthographic top sectional view of the mesh fabric defining the canopy of the organization.
Figure 4A:
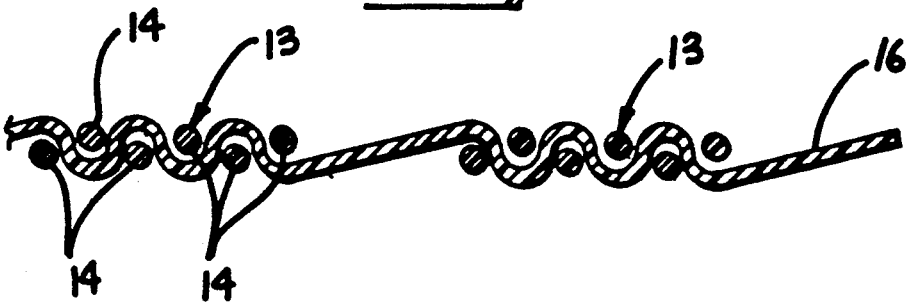
FIG. 4*a* is an orthographic view, taken along the lines 4*a*—4*a* of FIG. 4, in the direction indicated by the arrows.

More specifically, the sunshade umbrella 10 of the instant invention essentially comprises a rigid central support column 11 vertically arranged and directed coaxially and medially of a downwardly directed concave canopy 12. The canopy 12 is formed of a heat and light reflective mesh lattice work. The lattice work is illustrated in FIG. 4 defined as a mesh pattern 12*a* of a typical 20×30 mesh. The mesh pattern 12*a* includes spaced groups of first parallel fibers 13. Each of the parallel fibers 13 include first filaments 14. The filaments 14 are separated by a first spacing between each of the first filaments, wherein a second spacing 15 is defined between adjacent groups of the first fiber matrix portions 13. Second filaments 16 are directed orthogonally through and interwoven between the first filaments 14 of the first fiber matrix portions 13. The second filaments 16 are spaced apart by a third spacing 19, wherein the third spacing 19 is greater than that of the second spacing 15, which in turn is greater than the first spacing defined between the adjacent first filaments 14. The individual filaments are defined by a 0.010 to 0.014 diameter formed of a polymeric or vinyl coated fiberglass yarn that is interwoven and is formed of a generally gray to black pigmented coloration, and wherein the mesh network defines a shading coefficient of 0.41 to 0.13 in a range of 0 to 85 degrees of profile angles directed at the mesh 12*a*. The profile angles are defined as a standard in the industry of sunshade screening and understood to be an incidence of angular direction to the mesh pattern 12*a* at angles measured from sun rays directed orthogonally at the mesh patterns 12*a* to an ever decreasing acute angle relationship relative to the pattern 12*a*.

Figure 5:
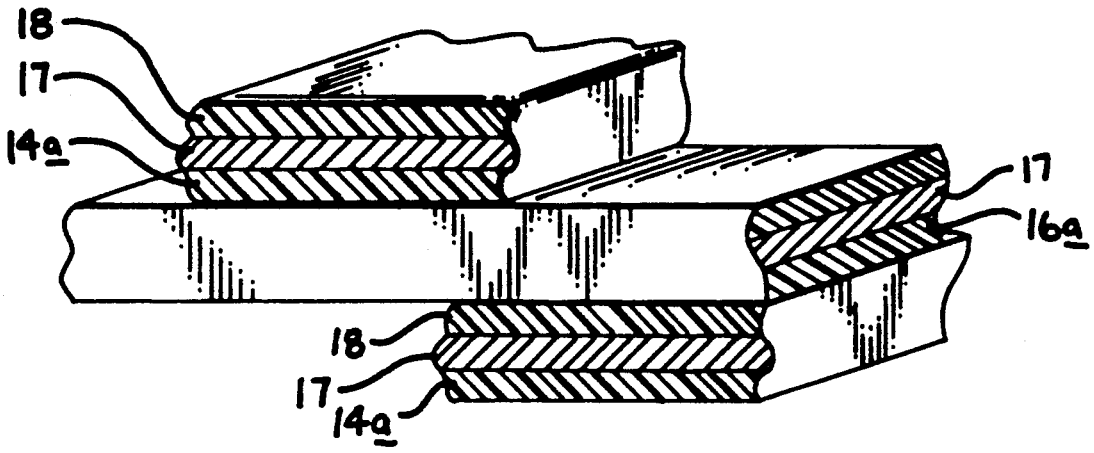
FIG. 5 is an isometric illustration of an alternative fabric construction of the instant invention.
Figure 6:
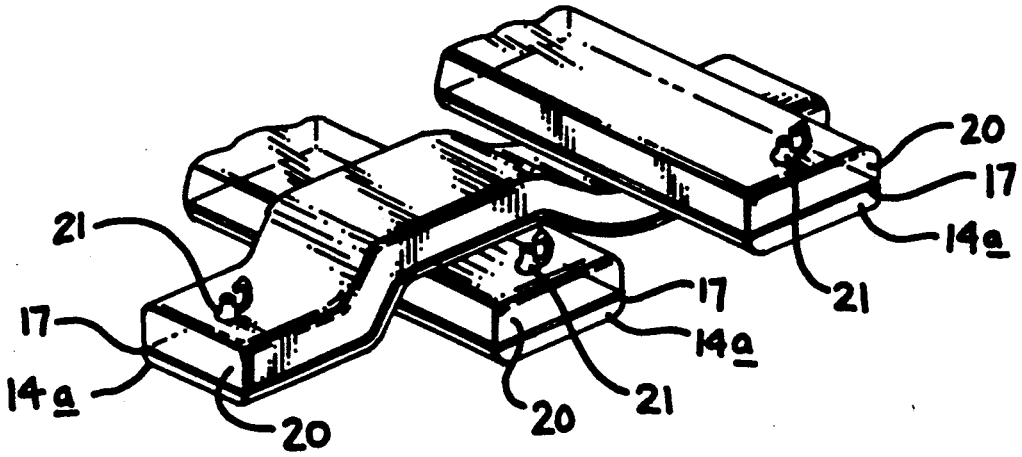
FIG. 6 is an isometric illustration of a yet further fabric construction of the instant invention.
Figure 7:
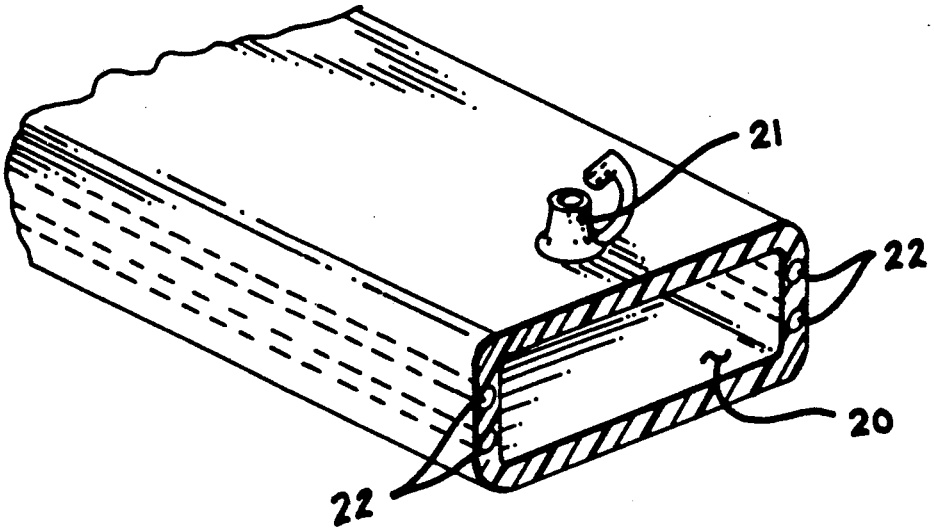
FIG. 7 is an isometric illustration of the pneumatic chamber organization, somewhat enlarged for purposes of illustration.

Reference to FIG. 5 illustrate a modification of the mesh pattern 12*a* utilizing fibers of laminated construction, as illustrated in FIGS. 5 and 6 for example. The modification of FIG. 5 includes a planar fiber 14*a* defined as a coated fiber glass yarn defining a width of 0.010 to 0.014, including a reflecting mirror sheet of either aluminum or polymeric construction. A transparent polymeric layer is laminated to and coextensively surmounting the reflective mirror sheet 17. FIG. 6 illustrates a modification of the transparent layer 18 defined as a pneumatic chamber 20, including a valve 21 arranged and formed to permit isolation of each pneumatic chamber to ensure geometric integrity of the canopy 12. FIG. 7 illustrates the pneumatic chamber, including pairs of elongate reinforcing wires 22 directed coextensively with and extending through parallel side walls of each of the pneumatic chambers, wherein such reinforcing wires also assist in effecting geometric integrity of the organization even during periods of deflation of the pneumatic chambers 20.

Figure 8:
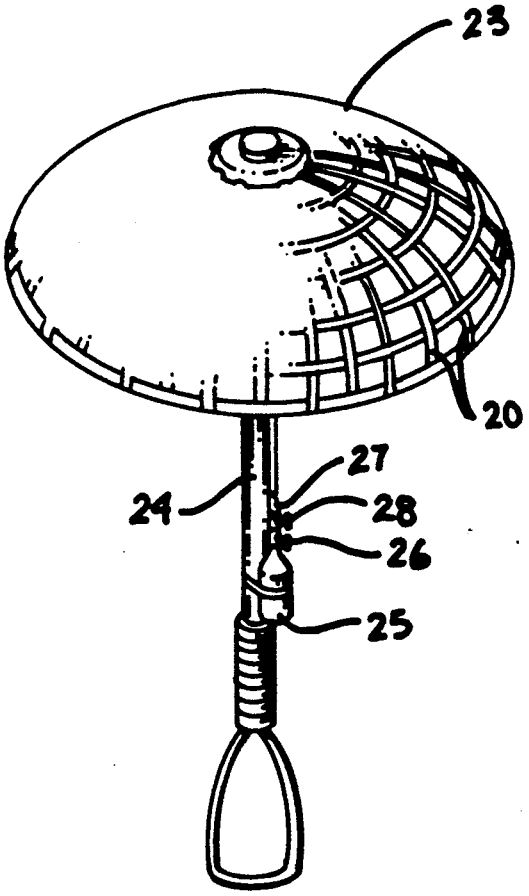
FIG. 8 is an isometric illustration of a modification of the instant invention utilizing an inflatable canopy construction.

FIG. 8 illustrates a modified umbrella structure, wherein the tubular support shaft 24 includes a helium canister 25 mounted thereto adjacent its lower terminal end, with an inflation valve 26 in association with the helium canister 25 to direct helium through a helium delivery conduit 27 directed through the shaft 24 and into a central manifold 23 and simultaneously directing the helium into the various pneumatic chambers 20. The organization further includes a deflation valve 28 in association with the helium delivery conduit 27 to permit deflation of the helium. The helium is utilized to assist individuals of limited physical capacity to support the umbrella structure for prolonged periods of time to an exposure to sunlight conditions.

As to the manner of usage and operation of the instant invention, the same should be apparent from the above disclosure, and accordingly no further discussion relative to the manner of usage and operation of the instant invention shall be provided.

With respect to the above described then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A sunshade umbrella comprising, a central support column, and the central support column including an upper terminal end, the upper terminal end of the support column coaxially and fixedly mounted to a downwardly directed concave canopy, and the concave canopy formed of a heat and light reflective open mesh lattice work to simultaneously permit air directed therethrough while reflecting heat and light therefrom, and wherein the open mesh lattice work is formed of a grid work of spaced flexible planar first fiber filament portions interwoven with planar second filament portions directed orthogonally through the first fiber matrix portions, and wherein each of the first and second planar filament portions further includes an upper surface and a reflective mirror layer laminated to said upper surface said planar filament portions, and further includes a transparent polymeric layer laminated to and coextensive with and overlying each of said reflective mirror layers, and wherein each of the transparent layers includes a pneumatic chamber, and each pneumatic chamber includes a valve mounted thereto permitting individual inflation of each pneumatic chamber, and wherein each pneumatic chamber includes spaced parellel side walls, and each of the side walls includes pairs of parallel reinforcing wires coextensively formed with each of the side walls to effect geometric integrity of said pneumatic chamber.

* * * * *